US005456772A

United States Patent [19]

Matsuki et al.

[11] Patent Number: 5,456,772

[45] Date of Patent: Oct. 10, 1995

[54] SUPPORT FOR A PLANOGRAPHIC PRINTING PLATE AND METHOD FOR PRODUCING SAME

[75] Inventors: Masaya Matsuki; Hirokazu Sawada; Akio Uesugi, all of Shizuoka, Japan

[73] Assignee: Fuji Photo Film Co., Ltd., Kanagawa, Japan

[21] Appl. No.: 132,871

[22] Filed: Oct. 7, 1993

[30] Foreign Application Priority Data

Nov. 20, 1992 [JP] Japan ..... 4-333862
Mar. 29, 1993 [JP] Japan ..... 5-091908

[51] Int. Cl.[6] ..... C22F 1/04

[52] U.S. Cl. ..... 148/551; 148/552; 148/692; 148/696; 148/437; 148/439; 204/129.1; 101/453; 101/459

[58] Field of Search ..... 148/551, 552, 148/692, 696, 437, 439; 204/129.1; 101/453, 459

[56] References Cited

U.S. PATENT DOCUMENTS 5,078,805 1/1992 Uesugi et al. ..... 148/692

OTHER PUBLICATIONS

Metals Handbook (9th Edition); vol. 4, Heat Treating, pp. 707–710; ASM, Metals Park, Ohio; 1981.

*Primary Examiner*—David A. Simmons
*Assistant Examiner*—Robert R. Koehler
*Attorney, Agent, or Firm*—Sughrue, Mion, Zinn, Macpeak & Seas

[57] ABSTRACT

A support for a planographic printing plate support in which variations in the quality of the material of the aluminum support are reduced to thereby improve the yield in an electrolytic graining treatment and which is excellent in susceptibility to graining, has no stripe irregularities, and excellent appearance, and a method for producing such a planographic printing plate. An aluminum plate material is formed through a twin-roller continuous casting apparatus and subjected to cold rolling. Successively, the plate is subjected to heat treatment so as to form a surface portion of a depth of at least 15 μm in the thickness direction having no recrystallization in the surface layer. If necessary, the plate may be subjected to cold rolling again as final rolling. Thereafter, the plate is subjected to correction.

4 Claims, 2 Drawing Sheets

SUPPORT FOR A PLANOGRAPHIC PRINTING PLATE AND METHOD FOR PRODUCING SAME

BACKGROUND OF THE INVENTION

The present invention relates to a method for producing a support for a planographic printing plate, and particularly relates to a method for producing an aluminum support having excellent electrolytic graining properties.

An aluminum plate (including aluminum alloy) is often used as a printing plate, particularly, a printing plate for use as an offset printing plate. In using an aluminum plate used as an offset printing plate support, it is generally necessary that the aluminum plate have a good adhesive property to a photosensitive layer and good water retentivity. For this purposes, the aluminum plate must be roughened to provide the aluminum plate with a uniform and finely grained surface. Because this roughening treatment has a remarkable influence on printing characteristics and durability during offset printing, the effect of the roughening treatment is an important factor in the production of the plate material.

An AC electrolytic graining method is generally employed for roughening an aluminum support for a printing plate. For the waveform of the current used in such a method, an ordinary sinusoidal wave form alternating current or a special waveform alternating current such as a square waveform alternating current, etc., can be employed. Graining of an aluminum plate is performed using such an alternating current with a suitable electrode such as a graphite electrode as a counter electrode.

The graining can generally be completed in one treatment, but in such a case the depth of the pits obtained by the graining is generally small, so that the resulting aluminum support is inferior in durability. Therefore, various methods have been proposed to obtain a suitable aluminum plate for use as a support for a printing plate having a grained surface in which pits having depths larger than their diameter are formed evenly. Examples of such methods are disclosed in Japanese Patent Unexamined Publication No. Sho. 53-67507, Japanese Patent Unexamined Publication No. Sho. 54-65607, Japanese Patent Unexamined Publication No. Sho. 55-25381, and Japanese Patent Unexamined Publication No. Sho. 56-29699, etc. Further, a method using a combination of an AC electrolytic etching and mechanical graining treatments is disclosed, for example, in Japanese Patent Unexamined Publication No. Sho. 55-142695.

A known method for producing an aluminum support includes steps of casting a slab (with a thickness of 400 to 600 mm, a width of 1000 to 2000 mm, and a length of 2000 to 6000 mm) by melting and holding an ingot of aluminum, applying a surface cutting to remove a thin portion (about 3 to 10 mm) from the surface of the slab to thereby remove the impurity-structure surface portion, evenly heating the slab in a furnace at a temperature of 480° to 540° C. for 6 to 12 hours in order to remove stress inside of the slab and equalize the surface portions of the slab, and then hot-rolling the slab at a temperature of 480° to 540° C. After the slab is hot-rolled to a thickness of 5 to 40 mm, the slab is cold-rolled to a predetermined thickness at room temperature. Then, to homogenize the surfaces and to make the plate excellent in flatness, annealing is carried out to thereby homogenize the rolled structure and the like. Then, cold rolling is carried out to obtain a predetermined thickness, and finally correction is carried out. The aluminum support thus produced is used as a support for a planographic printing plate.

An electrolytic graining treatment is apt to be affected by the characteristics and composition of the aluminum support subjected to the treatment. That is, in the production of an aluminum support through the steps of melting/holding, casting, surface cutting and soaking, there can arise variations of the components of the metal alloy in the surface layer, even in the case where not only heating and cooling are alternately carried out, but also surface cutting is employed, that is, a step of cutting away the surface layer is carried out. This causes a lowering of the yield rate of the aluminum support for a planographic printing plate.

To reduce variations in the quality of the material of the aluminum support so as to improve the yield rate in the electrolytic graining treatment and to thereby produce a planographic printing plate excellent both in quality and in yield, there has been proposed a method for producing a support for a planographic printing plate including steps of forming a hot-rolled thin-plate coil by continuously carrying out casting from molten aluminum and hot rolling, applying cold rolling, a heat treatment and applying correction to the coil to thereby obtain an aluminum support, and then graining the aluminum support (see U.S. Pat. No. 5,078,805 which corresponds to Japanese Patent Unexamined Publication No. Hei. 3-79798).

In such a method, however, there can still arise variations in the electrolytic graining treatment of the plate. In addition, stripe irregularities sometimes occur in the grained surface so that the external appearance of the plate is sometimes poor.

SUMMARY OF THE INVENTION

Accordingly, an object of the present invention is to provide a support for a planographic printing plate in which variations in the quality of the material of the aluminum support can be reduced to thereby improve the yield in the electrolytic graining treatment, which is excellent in its susceptibility to graining, and which has no stripe irregularities and is excellent in the external appearance. It is also an object of the invention to provide a method for producing such a support for a planographic printing plate.

The foregoing and other objects of the invention have been met by a support for a planographic printing plate in the form of an aluminum plate having a surface portion to a depth of 15 μm in the direction of thickness thereof which is not recrystallized, while remaining portions of the aluminum plate from the surface portion toward its center are recrystallized.

The foregoing and other objects of the invention are also satisfied by a method for producing a support for a planographic printing plate in which, after molten aluminum is formed directly into an aluminum plate of a thickness of 4 to 30 mm through continuous casting using twin rollers, the plate is subjected to cold rolling to reduce its thickness by 60 to 95%, the plate is then subjected to a heat treatment and correction so that a portion of a thickness of at least 15 μm in which no recrystallization takes place is formed in the surface of the aluminum plate, and the thus-prepared aluminum support is subjected to surface graining.

To form a thin-plate coil by casting from molten aluminum to form an aluminum plate directly with use of twin rollers, as is performed in the method according to the present invention, thin-plate continuous casting techniques such as a Hunter method, a 3C method, etc., can be employed. Further methods of producing a thin-plate coil are disclosed in Japanese Patent Unexamined Publications Nos. Sho. 60-238001 and Sho. 60-240360.

First, a thin plate having a thickness of 4 to 30 mm is formed through hot rolling, the thickness of the thin plate is reduced 60 to 95% through cold rolling, and then a heat treatment, cold rolling for finishing, and correction are performed on the thin plate to make the thin plate suitable as a printing plate support.

Another object of the present invention is the provision of a method for producing a support for a planographic printing plate in which variations in the quality of the material of the aluminum support are reduced to thereby improve the yield in the electrolytic graining treatment, which is excellent in its susceptibility to graining, produces no stripe irregularities, and is excellent in the external appearance.

The foregoing object of the present invention can be achieved by a method for producing a support for a planographic printing plate in which, after molten aluminum is formed directly into an aluminum plate through continuous casting using a twin rollers, the aluminum plate is subjected to cold rolling, heat treatment and correction to thereby prepare an aluminum support, and the thus-prepared aluminum support is subjected to surface graining, characterized by the steps of: forming a thin plate of a thickness of 4 to 30 mm in the step of continuous casting, reducing the thickness of the thin plate by 60 to 95% in the step of cold rolling, annealing the thin plate at 260° to 300° C. for a time not shorter than 8 hours, and further reducing the thickness of the thin plate by 30 to 90% through finishing cold rolling.

The above object of the invention is also achieved by a method for producing a support for a planographic printing plate in which, after molten aluminum is formed directly into an aluminum plate through continuous casting by using twin rollers, the aluminum plate is subjected to cold rolling, heat treatment and correction to thereby prepare an aluminum support, and the thus-prepared aluminum support is subjected to surface graining, characterized by the steps of: forming a thin plate of a thickness of 4 to 30 mm in the step of continuous casting, reducing the thickness of the thin plate to 0.3 mm to 3.0 mm in the step of cold rolling, performing two types of intermediate annealing on the thickness-reduced thin plate at 500° C. to 660° C. for 1 second to 600 seconds and at 260° C. to 300° C. for 8 hours to 12 hours, and further reducing the thickness of the thin plate to 0.1 mm to 1.0 mm. As in the previously described case, to form a thin-plate coil by casting from molten aluminum into the form of a plate directly with use of twin rollers, thin-plate continuous casting techniques such as a Hunter method, a 3C method, etc., can be used, as can the methods of producing a thin-plate coil disclosed in Japanese Patent Unexamined Publication Nos. Sho-60-238001 and Sho-60-240360, etc.

First, a thin plate having a thickness of 4 to 30 mm is formed through hot rolling. Next, the thickness of the thin plate is reduced by 60 to 95% through cold rolling, the thin plate is annealed at 260° to 300° C. for a time not shorter than 8 hours, then the thickness of the thin plate is finally reduced by 30 to 90% through the cold rolling again, and thereafter the thin plate is subjected to a correcting device to make the thin plate excellent in flatness.

Alternatively, the thickness of the thin plate after continuous casting is reduced to 0.3 mm to 3.0 mm through cold rolling. The thin plate is then subjected to high temperature annealing at a temperature not lower than 500° C. for a 1 second to 600 seconds and low-temperature and long-time intermediate annealing at 260° C. to 300° C. for 8 hours to 12 hours, and subjected to finishing cold rolling so that the thickness is reduced to 0.1 mm to 1 mm, and then subjected to a correction device. Either one of the two intermediate annealing conditions may be executed first, and rolling may be inserted between the two intermediate annealing conditions.

DESCRIPTIONS OF THE PREFERRED EMBODIMENTS

Figure 1:
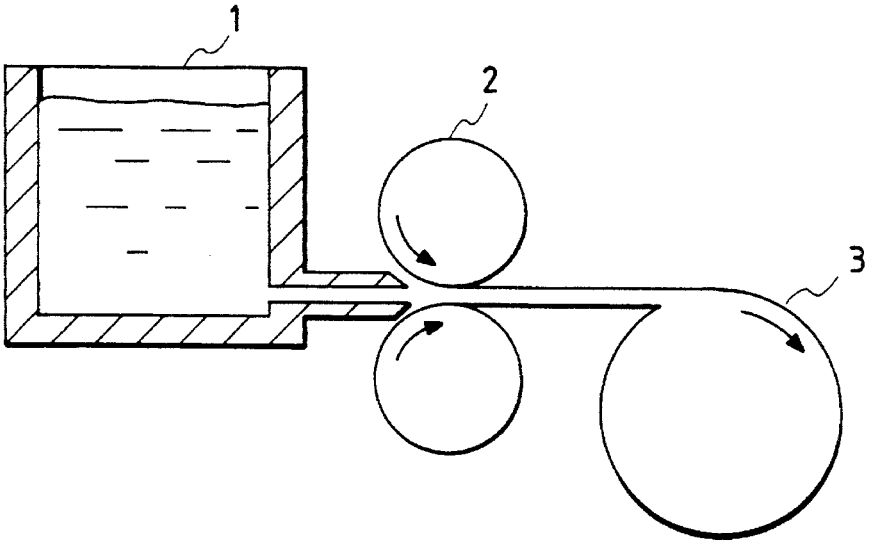
FIG. 1 is a schematic view of a continuous casting machine, which is used in the present invention.

A preferred embodiment of an aluminum support producing method in accordance with the present invention will be described more specifically with reference to the process schematic view of FIG. 1. Reference numeral 1 designates a melting/holding furnace in which an ingot is melted and held. Molten aluminum is delivered from the furnace to a twin-roller continuous casting machine 2. That is, a hot-rolled thin-plate coil with a thickness of 4 to 30 mm is formed directly from the molten aluminum and taken up by a coiler 3.

Figure 2:
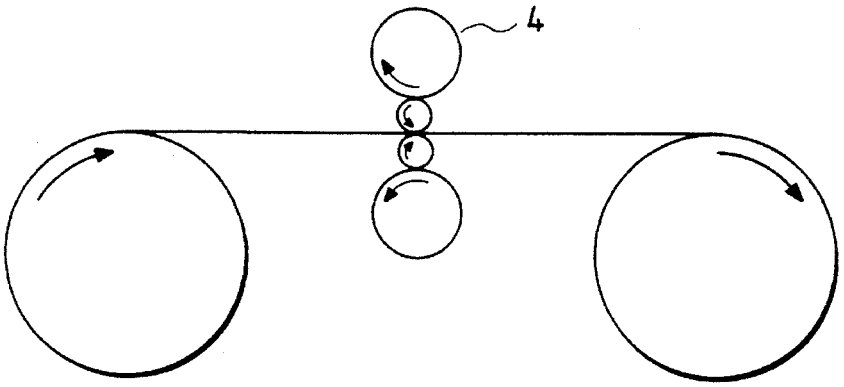
FIG. 2 is a schematic view of a cold rolling step of the present invention.

Thereafter, the thin plate is passed through a cold rolling mill 4, as shown in FIG. 2. Succeedingly, the thin plate is subjected to a heat treatment in the heat treatment step 5 depicted FIG. 3 under the condition that no recrystallization takes place in a region from the plate surface layer to a depth of at least 15 μm in its thickness direction. In this case, the heat treatment may be performed after final rolling by again using the cold rolling mill 4. Thereafter, the material is subjected to a correction device 6 as shown in FIG. 4. The plate material thus obtained is subjected to a graining treatment.

Considering the above process in more detail, it is necessary to hold the aluminum at a temperature not lower than the melting point thereof in the melting/holding furnace 1. The melting temperature varies according to the components of the aluminum alloy, but is generally 800° C. or higher.

Further, to suppress oxide of the molten aluminum and to remove alkaline metal impurities which are harmful to quality, there may be carried out inert gas purging, flux treatment, etc., if necessary.

Then, casting is carried out using the twin-roller continuous casting machine 2. Although there are various casting methods available, the most commonly used methods in current industrially-running are a Hunter method, a 3C method, and the like. Although the casting temperature varies according to the system or the alloy, a temperature of about 700° C. is generally used. In the case where a Hunter method or a 3C method is employed, rolling can be carried out between the twin rollers while the molten aluminum is solidified. Thereafter, the thickness of the aluminum is reduced through cold rolling, and the distribution of alloy components is made uniform through heat treatment. In this case, however, the state of the grained surface of the final product may sometimes become nonuniform. Accordingly, rolling is performed with the cold rolling mill 4 so that the thickness of the continuously cast thin plate is reduced by 60 to 95%. Thereafter, the heat treatment is performed under conditions such that no recrystallization takes place in a region from the surface to a depth of at least 15 μm in the thickness direction of the plate. Cold rolling is performed again for finishing.

Although the conditions for the heat treatment cannot be defined absolutely because they vary depending on the thickness of plate, it is generally suitable for the temperature to be in the range of 260° to 300° C. in the case where the thickness of the plate is 0.4 to 0.7 mm. In this case, there is no recrystallization in the surface portion to a depth 15 μm or more. Then, correction is carried out by the correction device 6 to thereby impart a predetermined flatness to the resulting plate prior to its being grained. The correction may be carried out in conjunction with the final cold rolling step.

As the method for graining the thin aluminum plate to form a support for a planographic printing plate in accordance with the present invention, there are available various methods such as mechanical graining, chemical graining, electrochemical graining and combinations thereof.

With respect to the mechanical graining method, there are known, for example, a ball graining method, a wire graining method, a brush graining method, a solution honing method, etc. As for the electrochemical graining method, there is generally used an AC electrolytic etching method employing either an ordinary sinusoidal alternating current or an alternating current having a special waveform such as a square waveform, etc. Further, etching with caustic soda may be carried out as a pretreatment of the electrochemical graining.

In the case of electrochemical graining, the surface is preferably grained with an aqueous solution mainly containing hydrochloric acid or nitric acid while applying an alternating current. A more detailed description will be given below.

First, the aluminum support is alkali-etched. Examples of the preferred alkali agent include caustic soda, caustic potash, metasilicate soda, sodium carbonate, aluminate soda, gluconate soda, etc. The concentration, temperature and treatment time period are preferably selected to be 0.01 to 20%, 20° to 90° C., and 5 seconds to 5 minutes, respectively. The preferred etching quantity is 0.1 to 5 g/m$^2$.

In the case of a support containing a particularly large amount of impurities, the etching quantity is preferably selected to be 0.01 to 1 g/m$^2$ (see Japanese Patent Unexamined Publication No. Hei-1-237197). De-smutting may be performed if necessary since alkali-insoluble smut may remain on the surface of the aluminum plate subjected to alkali-etching.

The above-described pretreatment is followed by AC electrolytic etching in an electrolytic liquid mainly containing hydrochloric acid or nitric acid in the present invention. The frequency of the alternating electrolytic current is selected to be 0.1 to 100 Hz, more preferably, 0.1 to 1.0 or 10 to 60 Hz.

The solution concentration is selected to be 3 to 150 g/l, more preferably, 5 to 50 g/l. The quantity of aluminum dissolution in the bath is selected to be not larger than 50 g/l, more preferably, 2 to 20 g/l. Although additives may be supplied if necessary, it becomes difficult to control the solution concentration and the like in the case of mass production.

The current density is selected to be 5 to 100 A/dm$^2$, more preferably, 10 to 80 A/dm$^2$. A suitable electric source waveform is selected in accordance with the components of the aluminum support to be used. Preferably, a special alternating waveform as described in U.S. Pat. No. 4,087,341 (which corresponds to Japanese Patent Postexamination Publications Nos. Sho. 56-19280 and Sho-55-19191) is used as the waveform. Such waveform and solution conditions are selected suitably in accordance with the applied voltage and current, the quality required, the compositions of the aluminum support to be used, etc.

The electrolytically grained is then immersed in an alkaline solution to thereby dissolve smuts. Although various kinds of alkali agents such as caustic soda can be used, it is preferable that the alkali treatment be performed in a very short time under the conditions of a pH of 10 or more, a temperature of 25° to 60° C., and an immersing period of 1 to 10 sec.

Then, the aluminum is immersed in a solution mainly containing sulfuric acid. As for the solution condition of sulfuric acid, there are preferred a concentration of 50 to 400 g/l, one-stage lower than the conventional case, and a temperature of 25° to 65° C. If the sulfuric acid concentration is not lower than 400 g/l or if the temperature is not lower than 65° C., corrosion of the treating cells and the like becomes intense, and accordingly the electrochemically grained surface may be destroyed in the case of an aluminum alloy containing 0.3% or more of manganese. If etching is carried out in such a manner that the quantity of dissolution of the aluminum base is not smaller than 0.2 g/m$^2$, durability during printing is lowered. Accordingly, the quantity of dissolution of the aluminum base is preferably selected to be not larger than 0.2 g/m$^2$. An oxidized surface of the anode is preferably formed on the surface in an amount of 0.1 to 10 g/m$^2$, preferably, in an amount of 0.3 to 5 g/m$^2$.

Although the anodic oxidation treatment conditions cannot be determined simply because it varies widely according to the electrolytic solution used, the electrolytic solution concentration, the solution temperature, the current density, the voltage and the electrolytic time are generally selected to be 1 to 80% by weight, 5° to 70° C., 0.5 to 60 A/dm$^2$, 1 to 100 V and 1 sec to 5 min, respectively.

Because the thus-obtained grained aluminum plate coated with the oxidized surface of the anode is stable by itself and has an excellent hydrophilic property, a photosensitive film can be provided thereon directly. If necessary, a surface treatment can be further applied thereto. For example, a silicate layer made of alkali metal silicate as described above or an undercoat layer made of a hydrophilic polymer compound can be provided. The coating quantity of the undercoat layer is preferably selected to be 5 to 150 mg/m$^2$.

Subsequently, a photosensitive layer is provided on the aluminum support treated as described above. After plate making is performed through image exposure and development, the plate is set in a printer to start printing.

EXAMPLES

An aluminum plate material having a thickness of 7.3 mm was formed using a twin-roller continuous casting apparatus 2 as shown in FIG. 1, and then subjected to cold rolling through the cold rolling mill 4 so that the thickness thereof was reduced to 0.5 mm. Through the heat treatment device 5, various samples in which the degree of recrystallization in the thickness direction was varied by suitably changing the condition of heat treatment as shown in Table 1 were obtained as an example of the present invention and comparative examples.

Figure 5:
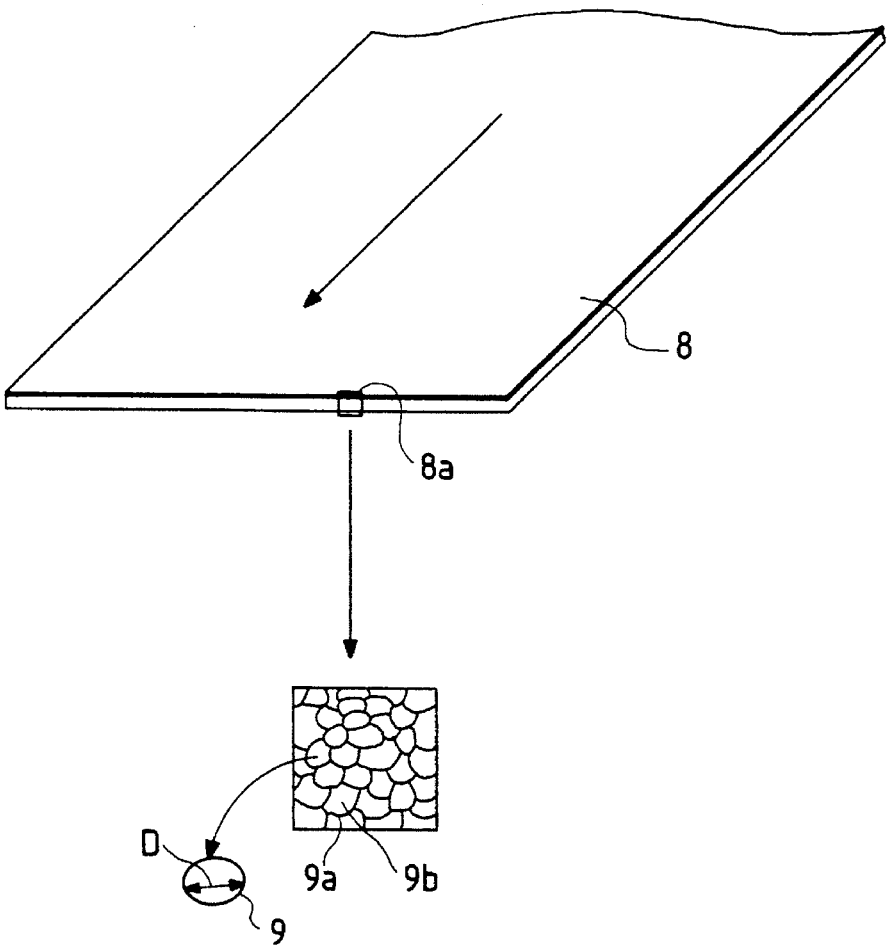
FIG. 5 is a schematic view showing the state of recrystallization in a section of an aluminum plate after annealing according to the present invention.

With respect to the samples obtained in the example and comparative examples, observation was carried out on the crystal grain sizes in the section perpendicular to the casting direction as shown in FIG. 5. Comparative evaluation was carried out on samples which were subjected to cold rolling to 0.24 mm plate thickness after heat treatment with 0.5 mm plate thickness.

TABLE 1

| Test No. | Example | State of Recrystallization | Condition of Heat Treatment |
|---|---|---|---|
| 1 | Example 1 | Recrystallizatio only in central portion | 280° C., 10 hrs |
| 2 | Comparative Example 1 | No recrystallization | None |
| 3 | Comparative Example 2 | Recrystallization in entire thickness | 600° C., 1 hr |

Each of the aluminum plates thus prepared was used as a support for a planographic printing plate as follows. The support was etched with an aqueous solution of 15% caustic soda at a temperature of 50° C. with an etching quantity of 5 g/m$^2$ and then washed with water. Then, the support was immersed in a solution of 150 g/l of sulfuric acid at 50° C. for 10 sec so as to be desmutted, and then was washed with water.

Subsequently, in an aqueous solution of 16 g/l of nitric acid, the support was grained electrochemically using an alternating current as described in U.S. Pat. No. 4,081,341 (which corresponds to Japanese Patent Postexamination Publication No. Sho. 55-19191). An anode voltage $V_A$=14 volts and a cathode voltage $V_c$=12 volts were used as the electrolytic condition so that the quantity of electricity at the positive electrodes was selected to be 350 coulomb/dm$^2$. An anode surface oxide coating of 2.5 g/m$^2$ was formed on each of the supports in a 20% sulfuric acid, and then dried.

Each of the substrate samples 1 to 5 thus prepared was coated with the following coating composition so that the weight of coating after drying was 2.0 g/m$^2$ to thereby provide a photosensitive layer.

| Photosensitive Coating Compositions: | |
|---|---|
| N-(4-hydroxyphenyl) methacrylamide/2-hydroxyethyl methacrylate/acrylonitrile/methyl methacrylate/methacrylic acid (mole ratio 15:10:30:38:7) copolymer (mean molecular weight 60000) | 5.0 g |
| hexafluophosphate salt of a condensate of 4-diazophenylamine and formaldehyde | 0.5 g |
| phosphorous acid | 0.05 g |
| Victoria Pure Blue BOH (made by Hodogaya Chemical Co., Ltd.) | 0.1 g |
| 2-methoxyethanol | 100.0 g |

Each of the photosensitive planographic printing plates thus prepared was exposed to a metal halide lamp of 3 kW at a distance of 1 m for 50 seconds through a transparent negative film in a vacuum printing frame, developed with a developing solution of the following composition and then gummed with an aqueous solution of gum arabic to thereby prepare a planographic printing plate.

| Developing Solution: | |
|---|---|
| Sodium sulfite | 5.0 g |
| benzyl alcohol | 30.0 g |
| sodium carbonate | 5.0 g |
| isopropylnaphthalenesodiumsulfonate | 12.0 g |
| pure water | 1000.0 g |

Using the planographic printing plates thus prepared, printing was performed in a general procedure. As a result, the data of Table 2 was obtained.

TABLE 2

| Test No. | Evaluation of Printing | Presence of Strip Irregularities | State of Pits |
|---|---|---|---|
| 1 | good | absent | uniform |
| 2 | poor | present | nonuniform |
| 3 | poor | present | nonuniform |

With respect to the same samples as were subjected to the above-mentioned printing test, their surfaces grained before application of the photosensitive layer were observed with an electron microscope. It was found from the observation that Tests Nos. 2 and 3, which were classified as poor results in the printing test, had nonuniform pits formed in the graining process compared with the Test No. 1.

As described above, the planographic printing plate produced by the support for a planographic printing plate producing method according to the present invention can improve the yield of electrolytic graining because variations in the quality of the aluminum support can be reduced. Furthermore, the planographic printing plate has excellent printing characteristics because it can be adapted to graining, and the planographic printing plate has no stripe irregularities and has an improved appearance.

Further, the aluminum support producing process can be rationalized to thereby attain a reduction in the cost of raw materials. Particularly, the present invention greatly contributes to improvement in quality and reduction in cost of the support for a planographic printing plate.

Another embodiment of the aluminum support producing method used in the present invention will be described more specifically again with reference to the process schematic view of FIG. 1. Reference numeral 1 designates a melting/holding furnace in which an ingot is melted and held. Molten aluminum is delivered from the furnace to a twin-roller continuous casting machine 2. That is, a hot-rolled thin-plate coil with a thickness of 4 to 30 mm is formed directly from the molten aluminum and wound up by a coiler 3.

Figure 3:
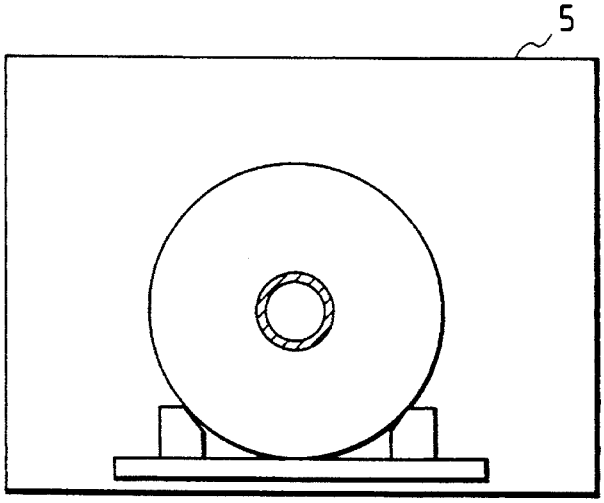
FIG. 3 is a schematic side view of a heat treatment step of the present invention.
Figure 4:
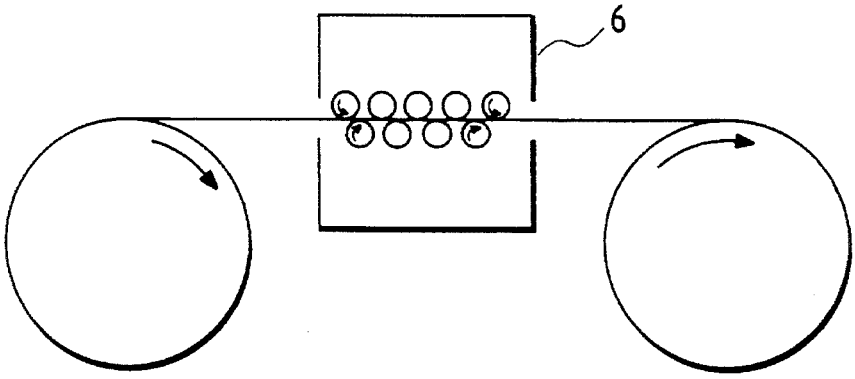
FIG. 4 is a schematic view of a correction step used in the present invention.

Thereafter, the thin plate is subjected to a cold rolling mill 4 to reduce the thickness thereof by 60 to 95%, succeedingly subjected to the heat treatment step 5 of FIG. 3 so as to be annealed at 260° to 300° C. for a time not shorter than 8 hours, then subjected to final rolling through the cold rolling mill 4 again to thereby reduce the thickness by 30 to 90%, and thereafter the thin plate is subjected to the correction device 6. The thus-obtained plate material is subjected to a surface graining treatment. Although the heat treatment step of FIG. 3 is an example of the batch system, the invention is not limited to such an application, the coil material may be subjected to a heat treatment continuously using a gas furnace or so.

As another method, the plate material can be subjected to the cold rolling mill 4 thereafter. After the cold rolling has been performed until the thickness of the material is reduced to 0.3 mm to 3.0 mm, the plate material is subjected to the heat treatment step illustrated in FIG. 3. In the heat treatment step, annealing at 500° C. to 660° C. for 1 second to 600 seconds and annealing at 260° C. to 300° C. for 8 hours to 12 hours are carried out. Either annealing step may be carried out first. A step of rolling may be carried out between the two annealing steps. Further, either one of the two annealing steps may be carried out. using a batch system and the other carried out using a continuous system. Thereafter, the plate material is subjected to the cold rolling mill 4 again as the final rolling step so that the thickness is reduced to a predetermined value of 0.1 mm to 1.0 mm. Subsequently, the plate material is subjected to the correction device 6 of FIG. 4. The thus-obtained plate material is subjected to surface graining.

In more detail, it is necessary to hold the aluminum at a temperature not lower than the melting point thereof in the melting/holding furnace 1. The temperature varies according to the aluminum alloy components. The temperature is generally 800° C. or more.

Further, to suppress oxidation of the molten aluminum and to remove alkaline metals harmful to quality, there may be carried out inert gas purging, flux treatment, etc., if necessary.

Then, casting is carried out using the twin-roller continuous casting machine 2. Although there are various casting methods available, the most commonly employed techniques are the Hunter method, the 3C method, etc. Although the casting temperature varies according to the system or the alloy, a temperature of about 700° C. may be used. In the case where the Hunter method or the 3C method is employed, rolling can be carried out between the twin rollers while the molten aluminum is solidified.

If the element distribution in section is observed using electronic probe microanalysis (hereinafter referred to as "EPMA") with respect to the plate material obtained in this stage, the element distribution will be found to be nonuniform in the thickness direction as well as in the widthwise direction, resulting in a disadvantage in that surface graining in the final product is nonuniform. Accordingly, the continuously cast plate material is rolled by the cold rolling mill 4 so that the thickness thereof is reduced by 60 to 95% or reduced to 0.1 mm to 1.0 mm.

If the element analysis in the surface at this point of time is observed through EPMA, the thin plate will be found to have a shape elongated in the rolling direction so that the element analysis is nonuniform, and if the crystalline microstructure in the surface is observed, the crystal will be seen to have a shape elongated in the rolling direction, resulting in a disadvantage that stripe irregularities and streaking after treatment are generated. Accordingly, an annealing step is carried out at 500° C. to 660° C. for 1 second to 600 seconds in order to make the crystalline grain size coincident, and another annealing step is carried out at 260° C. to 300° C. for 8 hours to 12 hours in order to make the element distribution uniform. Thereafter, the thickness of the plate material is reduced by 30% to 90% or reduced to 0.1 mm to 1.0 mm to thereby form a thin plate, and then the plate material is subjected to correction through the correction device 6.

Other conditions may be as previously described. That is, the same techniques for casting, graining, etc., as previously described can be used.

EXAMPLES

Further examples according to the above-described embodiment will now be discussed.

Example 2

An aluminum plate material having a thickness of 7.3 mm was formed using a continuous casting apparatus 2 as shown in FIG. 1, and then subjected to cold rolling so that the thickness thereof was reduced to 0.5 mm. After annealing while varying the annealing conditions as shown in Table 3 below, the plate material was further subjected to cold rolling so that the thickness was reduced to 0.24 mm to thereby form test materials.

TABLE 3

| Sample No. | Example | Plate thickness after annealing | Conditions for annealing |
|---|---|---|---|
| 1 | Example 2 | t = 0.5 mm | 280° C., 10 hrs |
| 2 | Comparative Example 3 | t = 0.5 mm | 280° C., 1 hr |
| 3 | Comparative Example 4 | t = 0.5 mm | 600° C., 10 hrs |
| 4 | Comparative Example 5 | t = 3.5 mm | 280° C., 10 hrs |

Each of the aluminum plates thus prepared was used as a support for a printing plate as follows. The support was etched with an aqueous solution of 15% caustic soda at 50° C. with an etching quantity of 5 g/m$^2$, and then washed with water. The support was next immersed in a solution of 150 g/l of sulfuric acid at 50° C. for 10 sec so as to be desmutted, and then was washed with water.

Then, in an aqueous solution of 16 g/l of nitric acid, the support was grained electrochemically using an alternating current as described in U.S. Pat. No. 4,087,341 (which corresponds to Japanese Patent Postexamination Publication No. Sho. 55-19191). An anode voltage $V_A$=14 volts and a cathode voltage $V_c$=12 volts were used as electrolytic conditions, so that the quantity of electricity at positive electrodes was 350 coulomb/dm$^2$. An anode surface oxide coating of 2.5 g/m$^2$ was formed on each of the supports in a 20% sulfuric acid, and then dried.

Each of the substrate samples 1 to 5 thus prepared was coated with the same photosensitive composition as used in Example 1 so that the weight of coating after drying was be 2.0 g/m$^2$ to thereby provide a photosensitive layer.

Each of the photosensitive planographic printing plates thus prepared was exposed to a metal halide lamp of 3 kW at a distance of 1 m for 50 seconds through a transparent negative film in a vacuum printing frame, developed with a developing solution of the same type used in Example 1 above, and then gummed with an aqueous solution of gum arabic to thereby prepare a planographic printing plate.

Using the planographic printing plates thus prepared, printing was performed in a general procedure. As a result, the data of Table 4 was obtained.

TABLE 4

| Sample No. | Evaluation of Printing | Presence of stripe irregularities | State of pits |
|---|---|---|---|
| 1 | good | absent | uniform |
| 2 | poor | present | nonuniform |
| 3 | poor | present | nonuniform |
| 4 | poor | present | nonuniform |

The same samples as subjected to the above-mentioned printing test with their surfaces grained before application of the photosensitive layer were observed with an electron microscope. It was found from the observation that Samples Nos. 2, 3 and 4, which were classified as poor results in the printing test had nonuniform pits formed in the graining process compared with Sample No. 1.

Example 3

By using such a continuous casting apparatus as shown in FIG. 1, an aluminum plate having a thickness of 7.3 mm was formed, subjected to cold rolling so that the plate thickness became 0.5 mm, then subjected to annealing in the annealing conditions shown in Table 5, and then subjected to finishing cold rolling so that the thickness became 0.24 mm to thereby prepare test materials.

TABLE 5

| Sample No. | Example | Plate thickness at annealing | Conditions of first annealing | Conditions of second annealing |
|---|---|---|---|---|
| 5 | Example 3 | t = 0.5 mm | 500° C., 3 sec | 280° C., 10 hrs |
| 6 | Comparative Example 4 | t = 0.5 mm | 500° C., 3 sec | None |
| 7 | Comparative Example 5 | t = 0.5 mm | 280° C., 10 hrs | None |
| 8 | Comparative Example 6 | t = 0.5 mm | None | None |

The thus-prepared aluminum plates were used as supports for planographic printing plates and subjected to surface graining under the same conditions as in the Example 2, and the substrates formed in the same manner as described above were subjected to appearance evaluation in order to judge the presence/absence of irregularities after treatment. Table 6 shows the results of evaluation.

TABLE 6

| Sample No. | Example | Presence of irregularities on treated surface |
|---|---|---|
| 5 | Example 3 | No irregularities |
| 6 | Comparative Example 4 | Stripe irregularities |
| 7 | Comparative Example 5 | No irregularities |
| 8 | Comparative Example 6 | Stripe irregularities |

Further, in order to carry out streak severe evaluation testing, the same test materials as those of Table 5 were used and the materials were made to be in a state where streaking could easily occur. Streak appearance evaluation was carried out under such conditions. Table 7 shows the results of the evaluation.

TABLE 7

| Sample No. | Example | Presence of streaking on treated surface |
|---|---|---|
| 5 | Example 3 | No streaks |
| 6 | Comparative Example 4 | No streaks |
| 7 | Comparative Example 5 | Streaks present |
| 8 | Comparative Example 6 | Streaks present |

As seen in Tables 4, 6 and 7, the planographic printing plate using the support for planographic printing plate produced by the process according to the present invention can improve the yield of electrolytic graining because the variation in the quality of the aluminum support is reduced. Furthermore, the planographic printing plate produced according to the invention has excellent printing characteristics because the support is well adapted for graining, and the planographic printing plate has no stripe irregularities and has an improved appearance.

Further, there is attained an important effect that the aluminum support producing process can be rationalized to thereby attain a reduction in cost of raw materials. Particularly, the present invention greatly contributes to improvement in quality and reduction in cost of the support for a planographic printing plate.

What is claimed is:

1. In a support for a planographic printing plate formed of an aluminum plate, the improvement wherein a range of said aluminum plate from a surface thereof to a depth of 15 μm in a direction of thickness thereof is not recrystallized while a portion of said aluminum plate from said range toward a center portion of said plate is recrystallized.

2. A method for producing a planographic printing plate, comprising the steps of: forming molten aluminum into an aluminum plate having a thickness in a range of 4 to 30 mm through continuous casting using twin rollers; cold rolling said aluminum plate to reduce a thickness of said aluminum plate by 60 to 95%; heat treating said aluminum plate so that a range from a surface of said aluminum plate to a depth of 15 μm in a direction of thickness thereof is not recrystallized while a portion of said aluminum plate from said range toward a center portion of said plate is recrystallized; subjecting said aluminum plate to correction to thereby prepare an aluminum support; and surface graining said aluminum support.

3. The method of claim 2, wherein said step of cold rolling is carried out to reduce the thickness of said aluminum plate to a range of 0.4 to 0.7 mm.

4. The method of claim 3, wherein said step of heat treating said aluminum plate comprises heating said aluminum plate to a temperature in a range of 260° to 300° C.

* * * * *